US009181751B1

(12) United States Patent
Hong

(10) Patent No.: US 9,181,751 B1
(45) Date of Patent: Nov. 10, 2015

(54) CONTROL ASSEMBLY FOR FOLDING/UNFOLDING AND ADJUSTING AN INCLINATION ANGLE OF SLATS OF A UNIVERSAL VENETIAN BLIND

(71) Applicant: Chin-Fu Chen, Taichung (TW)

(72) Inventor: Hans Hong, Changhua County (TW)

(73) Assignee: Chin-Fu Chen, Taichung (TW)

( * ) Notice: Subject to any disclaimer, the term of this patent is extended or adjusted under 35 U.S.C. 154(b) by 0 days.

(21) Appl. No.: 14/265,485

(22) Filed: Apr. 30, 2014

(51) Int. Cl.
*E06B 9/322* (2006.01)
*E06B 9/28* (2006.01)

(52) U.S. Cl.
CPC .. *E06B 9/322* (2013.01); *E06B 9/28* (2013.01)

(58) Field of Classification Search
CPC ..... E06B 9/304; E06B 9/305; E06B 9/306; E06B 9/307; E06B 9/322; E06B 9/327; E06B 9/28
USPC .... 160/168.1 R, 173 R, 170, 176.1 R, 177 R, 160/178.1 R
See application file for complete search history.

(56) References Cited

U.S. PATENT DOCUMENTS

| | | | | |
|---|---|---|---|---|
| 5,060,709 | A * | 10/1991 | Simon | 160/168.1 R |
| 6,253,823 | B1 * | 7/2001 | Swopes et al. | 160/168.1 R |
| 7,832,453 | B2 * | 11/2010 | Lin | 160/168.1 R |
| 2007/0056692 | A1 * | 3/2007 | Nien et al. | 160/168.1 R |
| 2014/0138036 | A1 * | 5/2014 | de Vries et al. | 160/176.1 R |

* cited by examiner

*Primary Examiner* — Blair M Johnson
(74) *Attorney, Agent, or Firm* — Muncy, Geissler, Olds & Lowe, P.C.

(57) ABSTRACT

A control assembly includes a control box mounted to a rail on a top of a Venetian blind. A longitudinal shaft is mounted in a box body of the control box and is rotatable along a longitudinal axis. An actuation string is wound around a friction wheel on the longitudinal shaft and can be operated to adjust an inclination angle of slats of the Venetian blind. A transverse shaft is mounted in the box body and extends perpendicularly to the longitudinal shaft. A direction-changing gear unit is mounted between the longitudinal shaft and the transverse shaft. The transverse shaft includes two string winding grooves each having increasing depths from two sides thereof towards a center thereof. The box body includes a bottom having a central string hole between two side string holes. The central string hole is divided by a transverse support and a longitudinal support.

3 Claims, 8 Drawing Sheets

CONTROL ASSEMBLY FOR FOLDING/UNFOLDING AND ADJUSTING AN INCLINATION ANGLE OF SLATS OF A UNIVERSAL VENETIAN BLIND

BACKGROUND OF THE INVENTION

The present invention relates to a control assembly for a Venetian blind and, more particularly, to a control assembly for folding/unfolding slats of a universal Venetian blind and for adjusting an inclination angle of the slats of the universal Venetian blind.

The inclination angle of slats of a Venetian blind can be adjusted in response to the incident angle and intensity of the sunlight. Typically, a Venetian blind includes a first control mechanism for controlling folding/unfolding the slats and a second control mechanism for controlling the inclination angle of the slats, resulting in a complicated structure.

Taiwan Invention Patent No. 1307736 discloses an inclination angle adjusting device for a window shade. The adjusting device includes a reel mounted in an upper track of the window shade, and a pull string is wound around the reel and extends downward through the slats and can be operated to fold or unfold the slats. A friction wheel is mounted to an end of the reel. A suspension string has a top end wound around the friction wheel and extends through the slats for balancing the slats. The suspension string can be pulled in the rotating direction of the reel to control the inclination angle of the slats.

By such an arrangement, since the reel and the friction wheel are coaxial and since the reel is in the middle, this adjusting device is only suitable for Venetian blinds including slats each having a pull string hole to allow the pull string to extend through and to allow smooth operation of the pull string. Namely, the adjusting device can not be used in Venetian blinds including slats without holes. However, Venetian blinds including slats without holes are high-quality Venetian blinds. Accordingly. the adjusting device has limited applications.

BRIEF SUMMARY OF THE INVENTION

A control assembly according to the present invention is provided for folding/unfolding slats of a universal Venetian blind and for adjusting an inclination angle of the slats of the universal Venetian blind. The control assembly includes a control box adapted to be mounted to a rail on a top of a Venetian blind including a plurality of slats. The control box includes a box body and a cover mounted to the box body. The box body includes a bottom having two side string holes spaced from each other. A longitudinal shaft is mounted in the box body and is rotatable along a longitudinal axis. A friction wheel is mounted to an end of the longitudinal shaft. An actuation string is adapted to be wound around the friction wheel. The actuation string can be operated to adjust an inclination angle of the plurality of slats of the Venetian blind. A transverse shaft is mounted in the box body and extends perpendicularly to the longitudinal shaft. A direction-changing gear unit is mounted between the longitudinal shaft and the transverse shaft. The transverse shaft includes a first string winding groove and a second string winding groove respectively adjacent to two ends of the transverse shaft. The first string winding groove has increasing depths from two sides of the first string winding groove towards a center of the first string winding groove. The second string winding groove has increasing depths from two sides of the second winding groove towards a center of the second string winding groove.

The bottom of the box body further includes a central string hole between the two side string holes. The box body further includes a transverse support extending in a transverse direction perpendicular to the longitudinal axis and a longitudinal support extending along an axis parallel to and spaced from the longitudinal axis. The central string hole is divided by the transverse support and the longitudinal support into a first section and a second section. The first section and the second section are distant to the first and second string winding grooves. The first section and the first string winding groove are located on a side of the longitudinal axis. The second section and the second string winding groove are located on the other side of the longitudinal axis.

If a pull string is used with the control assembly, the pull string extends from the second section to the first string winding groove or extends from the first section to the second string winding groove.

A first imaginary line passes through a connection between the transverse support and the longitudinal support in the first section and a lowest point in the second string winding groove, a second imaginary line passes through the lowest point in the second string winding groove and extends parallel to the longitudinal axis, and an angle between the first and second imaginary lines is larger than zero.

A third imaginary line passes through a connection between the transverse support and the longitudinal support in the second section and a lowest point in the first string winding section, a fourth imaginary line passes through the lowest point in the first string winding groove and extends parallel to the longitudinal axis, and an angle between the third and fourth imaginary lines is larger than zero.

In an example, the direction-changing gear unit includes a first helical gear mounted on the transverse shaft and located between the first and second string winding grooves. The direction-changing gear unit further includes a second helical gear mounted on the longitudinal shaft and meshed with the first helical gear.

In an example, the box body further includes a sidewall. The transverse shaft is located between the transverse support and the sidewall of the box body. The sidewall of the box body includes two openings on opposite sides of the longitudinal axis and respectively aligned with the first and second string winding grooves. A partitioning rib is formed in each of the two openings and separates the opening into two smaller openings.

The present invention will become clearer in light of the following detailed description of illustrative embodiments of this invention described in connection with the drawings.

DETAILED DESCRIPTION OF THE INVENTION

With reference to FIGS. 1-5, a control assembly according to the present invention is provided for folding/unfolding slats 61 of a Venetian blind 6 and for adjusting an inclination angle of the slats 61 of the Venetian blind 6. The Venetian blind 6 can be of any type.

Figure 4:
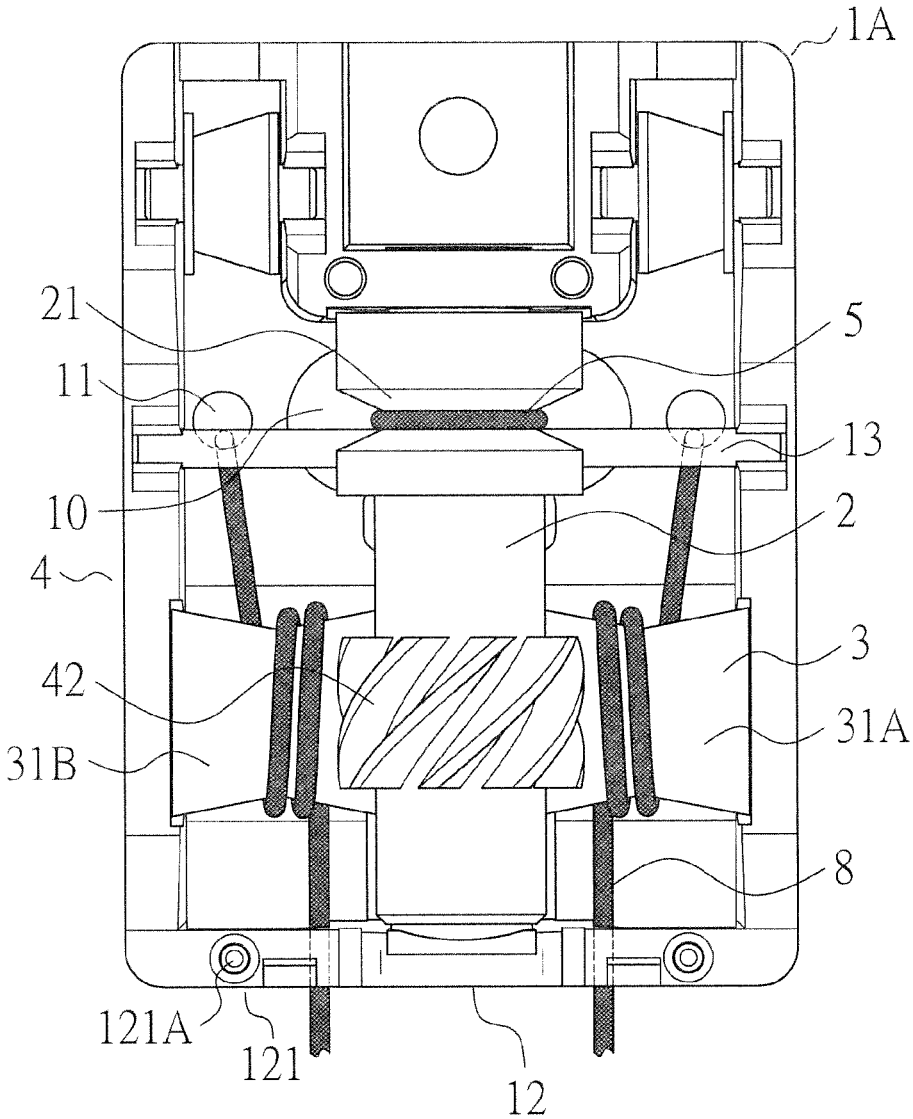
FIG. 4 is a top view of the control assembly of FIG. 3.
Figure 5:
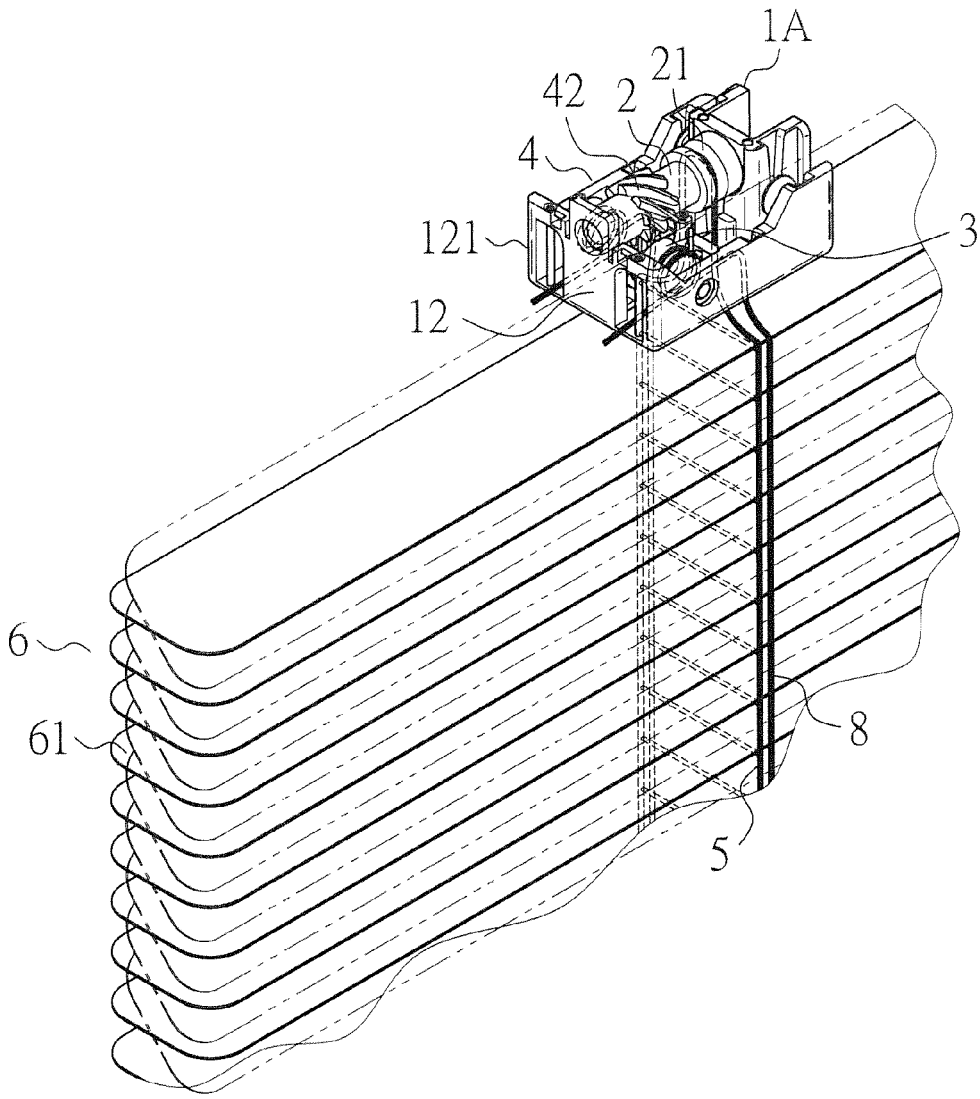
FIG. 5 is a schematic perspective view of a portion of the Venetian blind and the control assembly of FIG. 1.

The control assembly includes a control box 1 adapted to be mounted to a rail 7 on atop of the Venetian blind 6. The control box 1 includes a box body 1A and a cover 1B mounted to the box body 1A. The box body 1A includes a bottom having two side string holes 11 spaced from each other, as shown in FIG. 4.

A longitudinal shaft 2 is mounted in the box body 1A and is rotatable along a longitudinal axis X. The longitudinal shaft 2 does not interfere with operation of two pull strings 8 for folding/unfolding of the slats 61. A friction wheel 21 is mounted to an end of the longitudinal shaft 2. An actuation string 5 is adapted to be wound around the friction wheel 21. The actuation string 5 can be operated to adjust an inclination angle of the slats 61 of the Venetian blind 6. The actuation string 5 can move slightly relative to the friction wheel 21 in response to friction, which can be appreciated by one skilled in the art.

A transverse shaft 3 is mounted in the box body 1A and extends perpendicularly to the longitudinal shaft 2. A direction-changing gear unit 4 is mounted between the longitudinal shaft 2 and the transverse shaft 3. The transverse shaft 3 includes a first string winding groove 31A and a second string winding groove 31B respectively adjacent to two ends of the transverse shaft 3. In the form shown, the first string winding groove 31A has increasing depths from two sides of the first string winding groove 31A towards a center of the first string winding groove 31A. Likewise, the second string winding groove 31B has increasing depths from two sides of the second winding groove 31B towards a center of the second string winding groove 31B. This allows easy winding of the pull strings 8. During winding, each pull string 8 is firstly wound around the lowest section of the first or second string winding groove 31A, 31B to form a first loop. The second loop of each pull string 8 pushes the first loop to one of the two sides of the first or second string winding groove 31A, 31B. Since the two sides of each of the first and second string winding grooves 31A and 31B are higher than the center of the first and second string winding grooves 31A and 31B, a stop wall effect is provided. Under the balance between the pushing effect and the stop wall effect, undesired entangling of the pull strings 8 can be avoided.

Since the control assembly according to the present invention includes the transverse shaft 3 and the direction-changing gear unit 4 between the transverse shaft 3 and the longitudinal shaft 2 and since the transverse shaft 3 including the first and second string winding grooves 31A and 31B adjacent to two ends thereof, each pull string 8 can extend through one of the side string holes 11 and then be wound in the first or second string winding groove 31A, 31B.

Furthermore, the side string holes 11 are not aligned with a corresponding string hole in each slat of a conventional Venetian blind. Instead, the side string holes 11 are aligned with two lateral sides of each slat of a Venetian blind of the type without pull string holes. Due to provision of the transverse shaft 3 with the first and second string winding grooves 31A and 31B, the pull strings 8 can extend through the side string holes 11 and be wound in the first and second string winding grooves 31A and 31B, as shown in FIG. 4. Thus, the control assembly can be used with delicate, high-quality Venetian blinds including slats free of the pull string holes.

Figure 7:
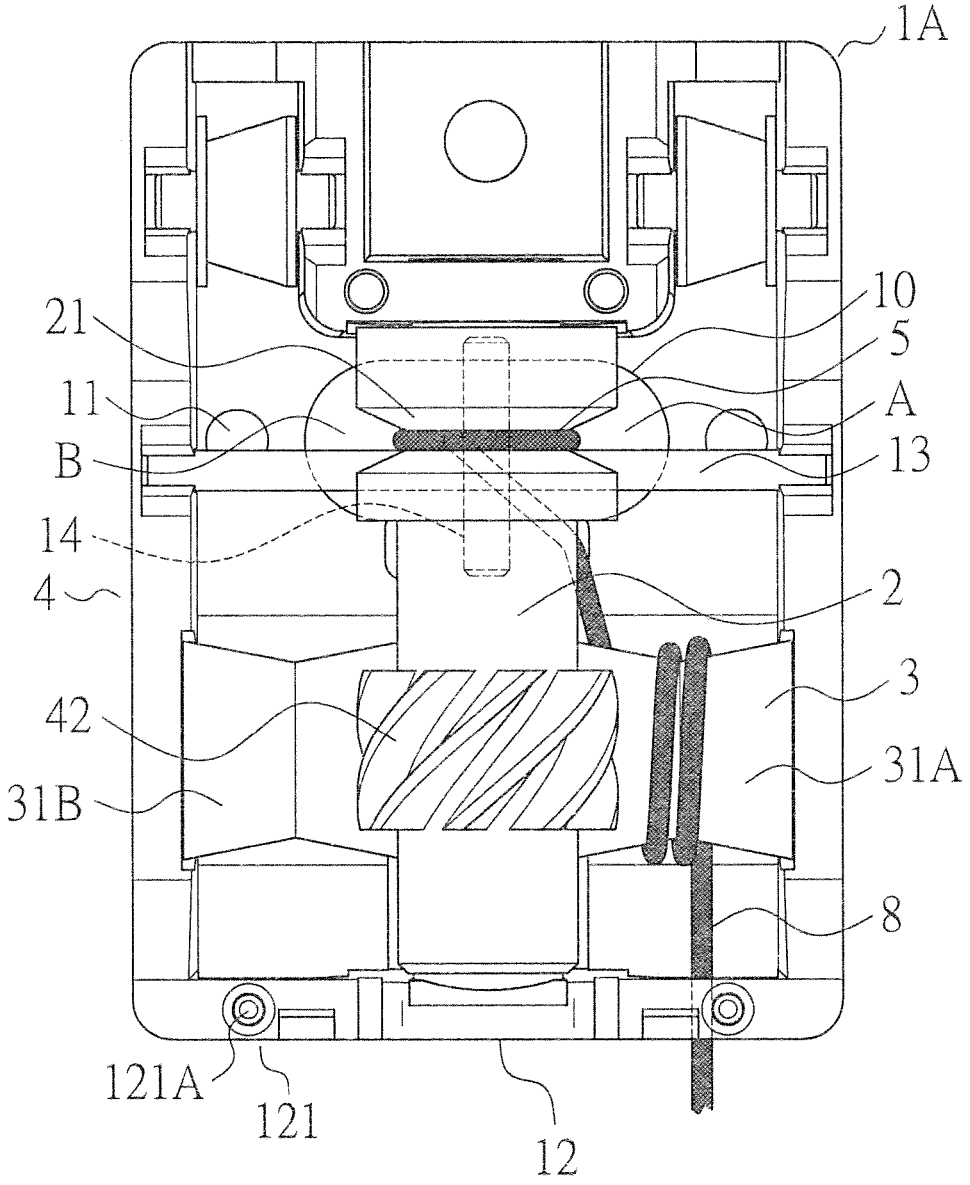
FIG. 7 is atop view of the control assembly according to the present invention, with a pull string wound in a different state.
Figure 8:
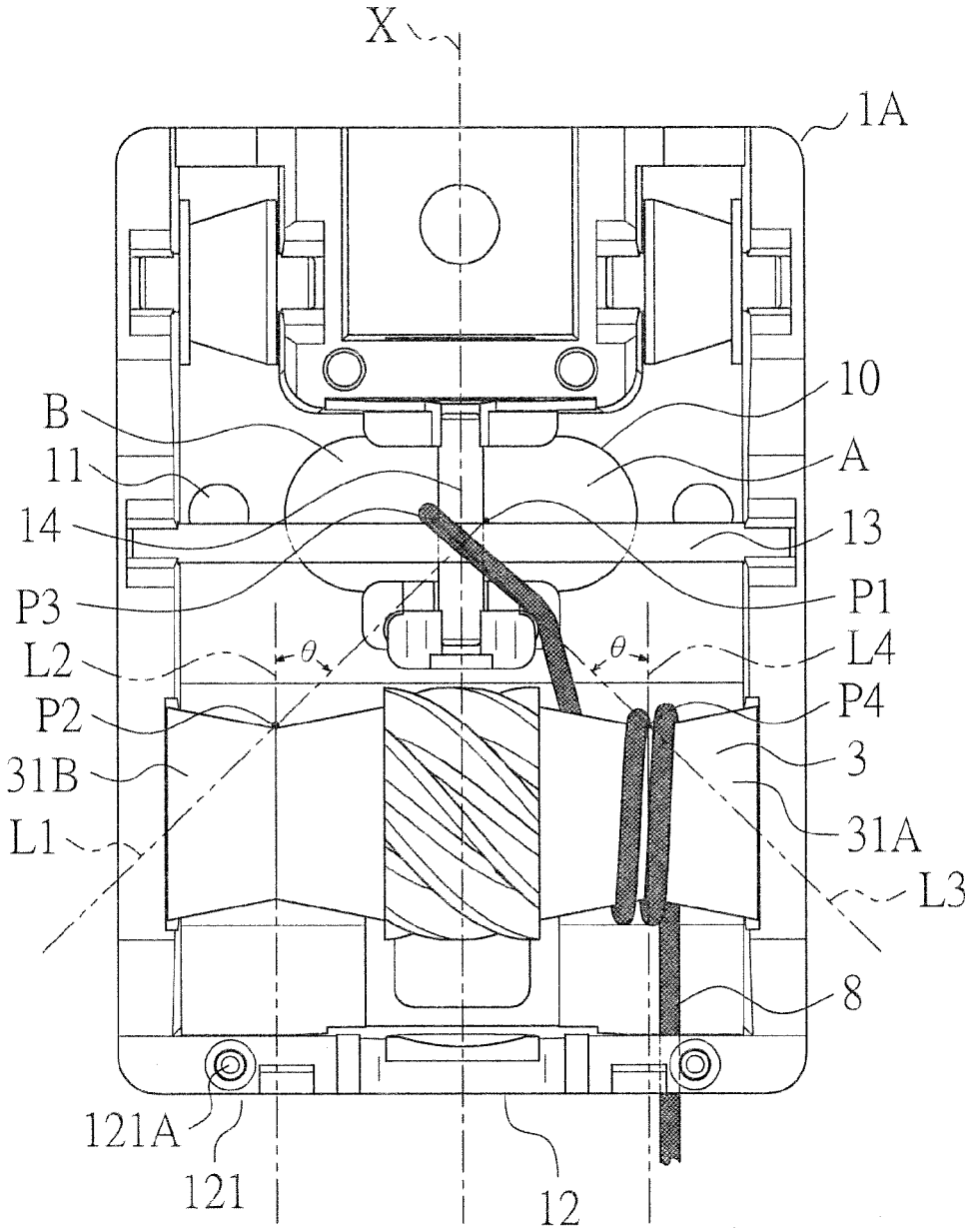
FIG. 8 is a top view of the control assembly of FIG. 7, with a longitudinal shaft removed.

With reference to FIGS. 7 and 8, the bottom of the box body 1A further includes a central string hole 10 between the side string holes 11. The box body 1A further includes a transverse support 13 extending in a transverse direction perpendicular to the longitudinal axis X and a longitudinal support 14 extending along an axis parallel to and spaced from the longitudinal axis X. The central string hole 10 is divided by the transverse support 13 and the longitudinal support 14 into a first section A and a second section B. The first section A and the second section B are distant to the first and second string winding grooves 31A and 31B. The first section A and the first string winding groove 31A are located on a side of the longitudinal axis X. The second section B and the second string winding groove 31B are located on the other side of the longitudinal axis X. Such an arrangement allows use of a single pull string 8. Specifically, if only one pull string 8 is used with the control assembly and extends through a corresponding pull string hole 610 of the Venetian blind 6 (e.g., the pull string hole 610 of each slat 61 of the Venetian blind 6 is located between two lateral sides of the slat 61), the pull string 8 extends from the second section B to the first string winding groove 31A or extends from the first section A to the second string winding groove 31B.

With reference to FIG. 8, a first imaginary line L1 passes through a connection P1 between the transverse support 13 and the longitudinal support 14 in the first section A and a lowest point P2 in the second string winding groove 31B. a second imaginary line L2 passes through the lowest point P2 in the second string winding groove 31B and extends parallel to the longitudinal axis X, and an angle θ between the first and second imaginary lines L1, L2 is larger than zero. A third imaginary line L3 passes through a connection P3 between the transverse support 13 and the longitudinal support 14 in the second section B and a lowest point P4 in the first string winding section 31A, a fourth imaginary line L4 passes through the lowest point P4 in the first string winding groove 31A and extends parallel to the longitudinal axis X, and an angle θ between the third and fourth imaginary lines L3, L4 is larger than zero.

Figure 6:
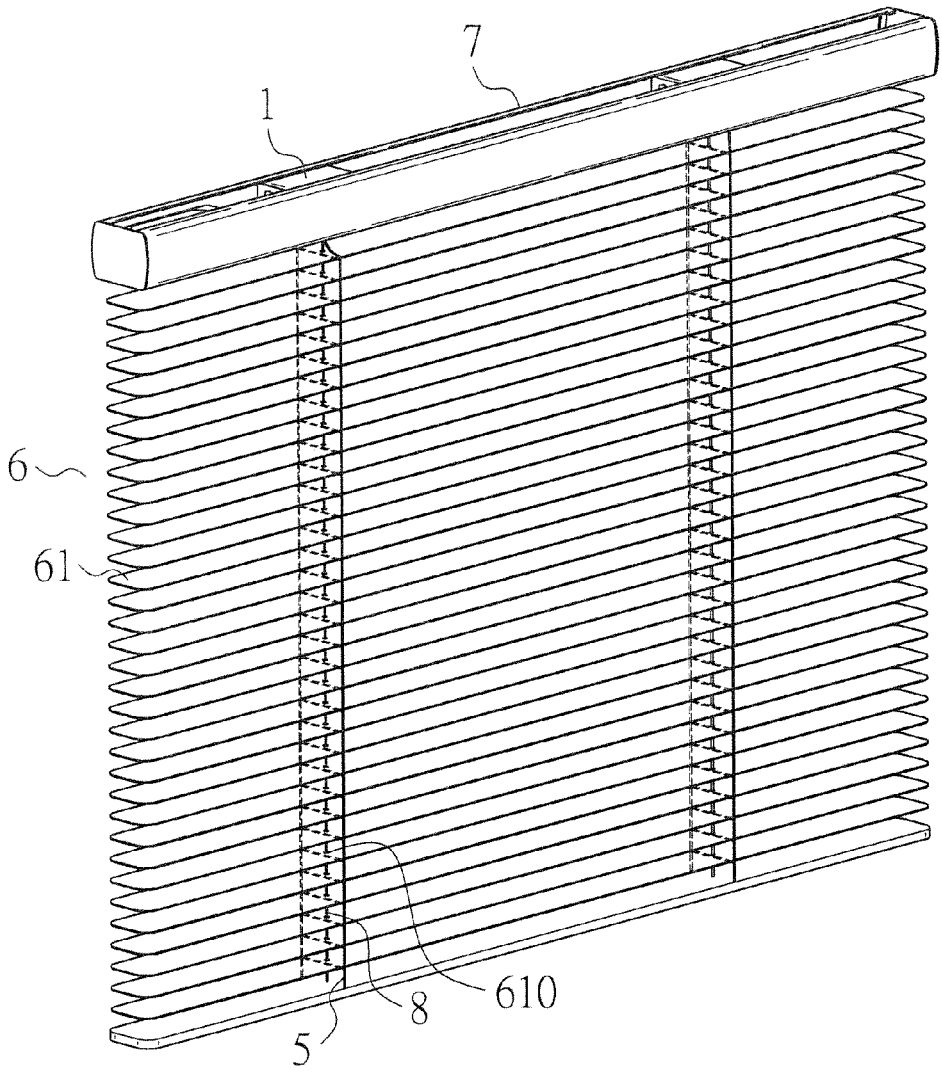
FIG. 6 is a perspective view of another Venetian blind using the control assembly according to the present invention, with each slat of the Venetian blind having two pull string holes.

In a case that each slat 61 of the Venetian blind 6 includes a pull string hole 610 corresponding to the control assembly and located in a center between the two lateral sides of the slat 61 (see FIG. 6), a pull string 8 can extend the pull string holes 610 of the slats 61 and extend through the pull string hole 610 into the box body 1A. Then, the pull string 8 can extend through the first section A or the second section B and then be wound in the second string winding groove 31B or the first string winding groove 31A (FIGS. 7 and 8).

As an example, if the pull string 8 extends through the second section B, the pull string 8 is wound in the first string winding groove 31A. Since the angle θ between the third imaginary line L3 (passing through the connection P3 between the transverse support 13 and the longitudinal support 14 in the second section B and the lowest point P4 in the first string winding section 31A) and the fourth imaginary line L4 (passing through the lowest point P4 in the first string winding groove 31A and extending parallel to the longitudinal axis X) is larger than zero, an angle deflection effect is provided to create a force component. Thus, the force component provided by the angle deflection and the corner friction provides the pull string 8 with a resistance such that the pull string 8 can withstand a heavier Venetian blind 6.

By such an arrangement, the control assembly can be used with Venetian blinds 6 including slats 61 with pull string holes 610 (FIG. 6) or without pull string holes (FIGS. 1 and 5), providing users with different choices.

Figure 1:
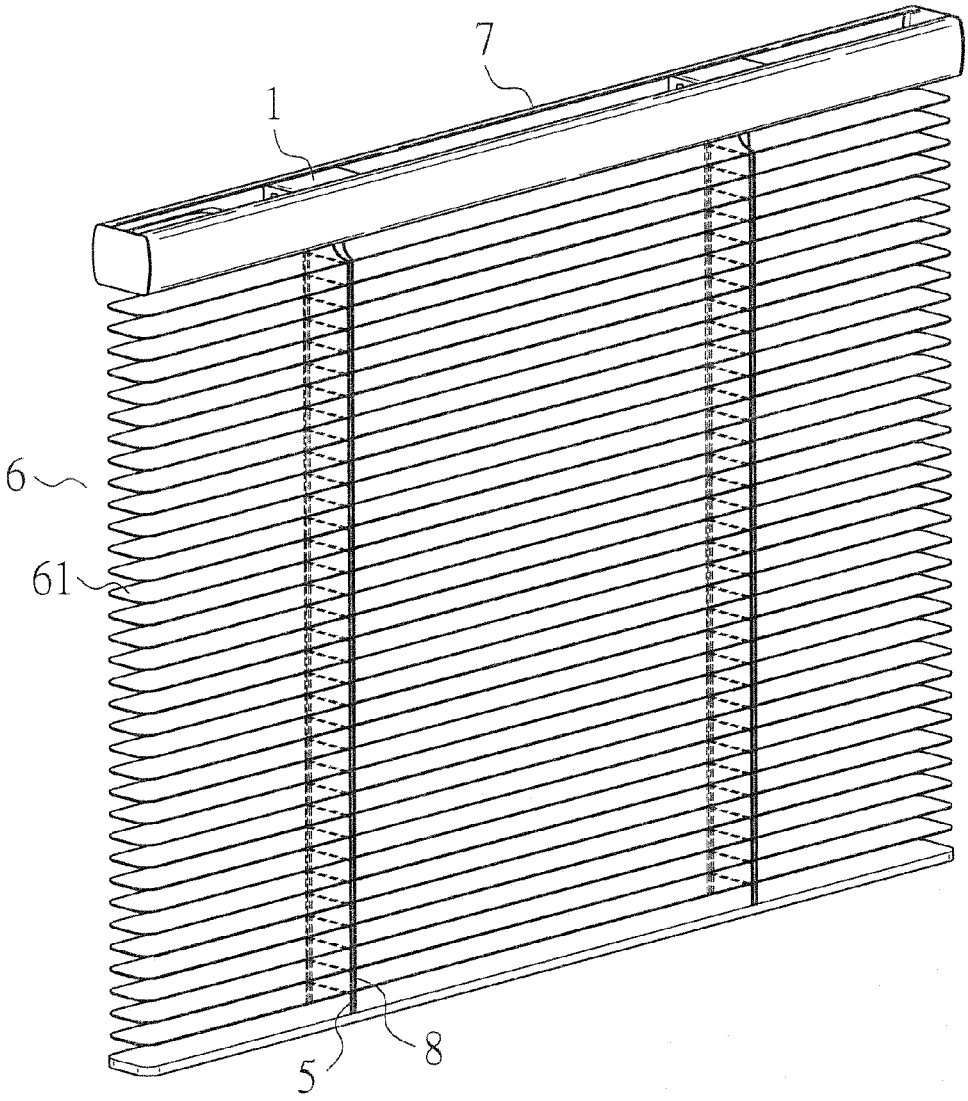
FIG. 1 is a perspective view of a Venetian blind using a control assembly of an embodiment according to the present invention.
Figure 2:
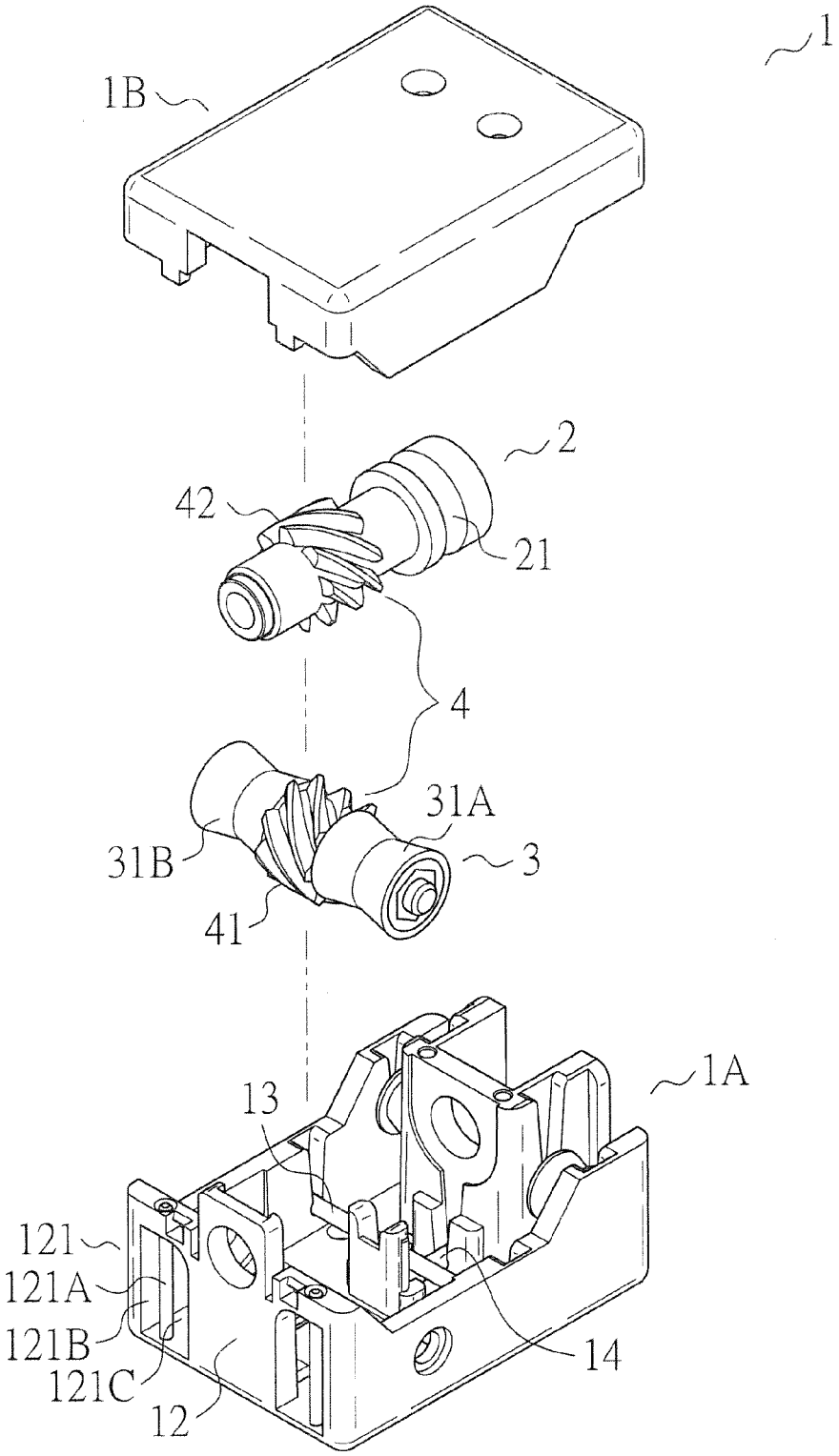
FIG. 2 is an exploded, perspective view of the control assembly of an embodiment according to the present invention.

With reference to FIG. 2, the direction-changing gear unit 4 includes a first helical gear 41 mounted on the transverse shaft 3 and located between the first and second string winding grooves 31A and 31B. The direction-changing gear unit 4 further includes a second helical gear 42 mounted on the longitudinal shaft 2 and meshed with the first helical gear 41. Thus, transmission and direction changing can easily be achieved.

Figure 3:
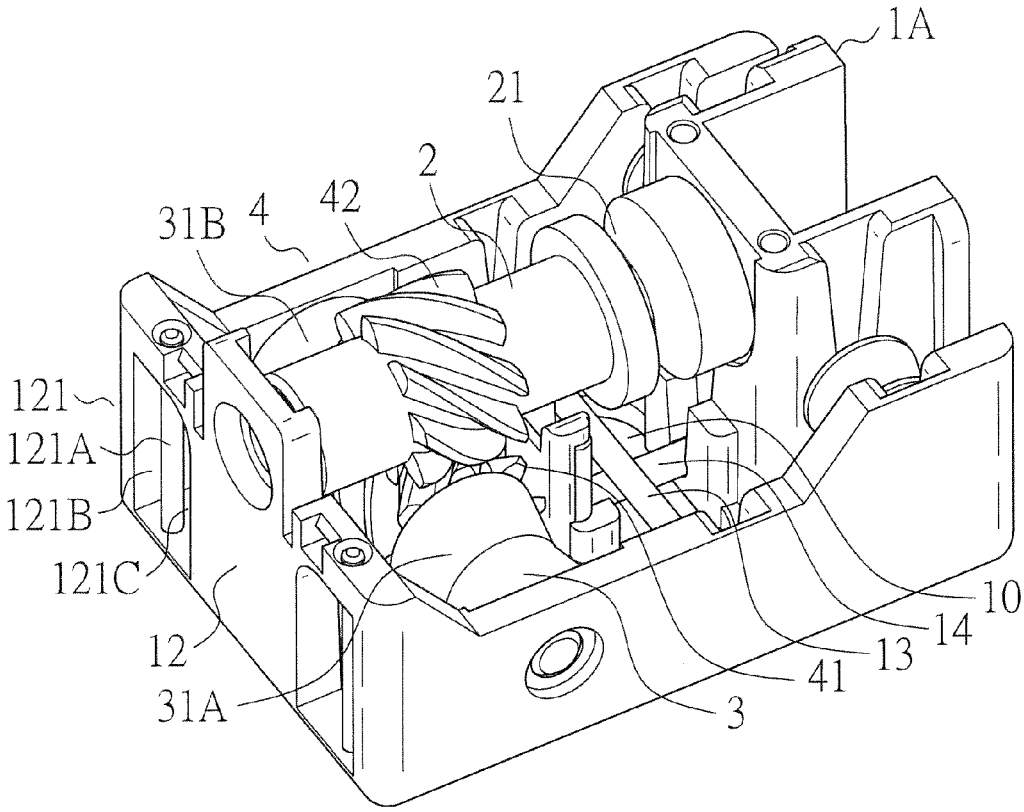
FIG. 3 is a perspective view of the control assembly of FIG. 2 after assembly.

With reference to FIGS. 2 and 3, the box body 1A further includes a sidewall 12. The transverse shaft 3 is located between the transverse support 13 and the sidewall 12 of the box body 1A. The sidewall 12 of the box body 1A includes two openings 121 on opposite sides of the longitudinal axis X and respectively aligned with the first and second string winding grooves 31A and 31B. A partitioning rib 121A is formed in each opening 121 and separates the opening 121 into two smaller openings 121B and 121C. Each pull string 8 can extend through one of the smaller openings 121B and 121C to restrain the pull string 8. avoiding wobbling of the pull string 8.

Although specific embodiments have been illustrated and described, numerous modifications and variations are still possible without departing from the scope of the invention. The scope of the invention is limited by the accompanying claims.

The invention claimed is:

1. A control assembly for folding/unfolding slats of a universal Venetian blind and for adjusting an inclination angle of the slats of the universal Venetian blind, with the control assembly comprising:

a control box adapted to be mounted to a rail on a top of a Venetian blind including a plurality of slats, with the control box including a box body and a cover mounted to the box body, and with the box body including a bottom having two side string holes spaced from each other;

a longitudinal shaft mounted in the box body, with the longitudinal shaft rotatable along a longitudinal axis, with a friction wheel mounted to an end of the longitudinal shaft, with an actuation string adapted to be wound around the friction wheel, and with the actuation string operable to adjust an inclination angle of the plurality of slats of the Venetian blind; and a transverse shaft mounted in the box body and extending perpendicularly to the longitudinal shaft, with a direction-changing gear unit mounted between the longitudinal shaft and the transverse shaft, with the transverse shaft including a first string winding groove and a second string winding groove respectively adjacent to two ends of the transverse shaft, with the first string winding groove having increasing depths from two sides of the first string winding groove towards a center of the first string winding groove, and with the second string winding groove having increasing depths from two sides of the second winding groove towards a center of the second string winding groove, with the bottom of the box body further including a central string hole between the two side string holes, with the box body further including a transverse support extending in a transverse direction perpendicular to the longitudinal axis and a longitudinal support extending along an axis parallel to and spaced from the longitudinal axis, with the central string hole divided by the transverse support and the longitudinal support into a first section and a second section, with the first section and the second section being distant to the first and second string winding grooves, with the first section and the first string winding groove located on a side of the longitudinal axis, and with the second section and the second string winding groove located on another side of the longitudinal axis, wherein if a pull string is used with the control assembly, the pull string extends from the second section to the first string winding groove or extends from the first section to the second string winding groove, wherein a first imaginary line passes through a connection between the transverse support and the longitudinal support in the first section and a lowest point in the second string winding groove, a second imaginary line passes through the lowest point in the second string winding groove and extends parallel to the longitudinal axis, and an angle between the first and second imaginary lines is larger than zero, and wherein a third imaginary line passes through a connection between the transverse support and the longitudinal support in the second section and a lowest point in the first string winding section, a fourth imaginary line passes through the lowest point in the first string winding groove and extends parallel to the longitudinal axis, and an angle between the third and fourth imaginary lines is larger than zero.

2. The control assembly as claimed in claim 1, with the direction-changing gear unit including a first helical gear mounted on the transverse shaft and located between the first and second string winding grooves, and with the direction-changing gear unit further including a second helical gear mounted on the longitudinal shaft and meshed with the first helical gear.

3. The control assembly as claimed in claim 1, with the box body further including a sidewall, with the transverse shaft located between the transverse support and the sidewall of the box body, with the sidewall of the box body including two openings on opposite sides of the longitudinal axis and respectively aligned with the first and second string winding grooves, with a partitioning rib formed in each of the two openings, and with each partitioning rib separating one of the openings into two smaller openings.

* * * * *